US005722822A

United States Patent [19]

Wilson et al.

[11] Patent Number: 5,722,822

[45] Date of Patent: Mar. 3, 1998

[54] FLAME SENSOR VERIFICATION

[75] Inventors: Larry E. Wilson, Marion; Craig R. Knotts, Fort Wayne; Daniel L. Kelly, Fort Worth, all of Ind.

[73] Assignee: Carrier Corporation, Syracuse, N.Y.

[21] Appl. No.: 433,183

[22] Filed: May 3, 1995

[51] Int. Cl.[6] ..... F23Q 23/00

[52] U.S. Cl. ..... 431/25; 431/24; 431/66; 431/77; 431/78; 431/12; 126/116 A

[58] Field of Search ..... 431/25, 24, 18, 431/66, 77, 13, 12, 14, 78; 126/116 A

[56] References Cited

U.S. PATENT DOCUMENTS 5,439,374 8/1995 Jamieson ..... 431/25
5,472,336 12/1995 Adams et al. ..... 431/6

*Primary Examiner*—Larry Jones

[57] ABSTRACT

Method and apparatus are disclosed for checking the responsiveness of a circuit which senses the presence of a flame produced by a burner within a furnace. A programmed processor associated with the circuit measures the time the circuit takes to indicate the presence of a flame. A warning is generated when the measured time exceeds a predetermined allowable time. The allowable time is determined by taking into account the decreased responsiveness of an electrode that indicates the presence of the burner flame.

13 Claims, 4 Drawing Sheets

FLAME SENSOR VERIFICATION

BACKGROUND OF THE INVENTION

This invention relates to sensing the presence and quality of a flame produced by an oil or gas burner within a furnace preferably heating a home or office building. In particular, this invention relates to verifying the operability of the circuitry for sensing the presence and quality of the flame.

Circuitry for sensing the presence and quality of a flame produced by a burner has heretofore included an electrode placed near the burner producing the flame. The electrode is conductive in the presence of a flame produced by the burner. This conductivity is noted within the circuitry as evidence that a flame has been produced by the burner.

The electrode may over time acquire a buildup of foreign material caused by air borne contaminants in the fuel supply to the burner. This coating tends to insulate the electrode thereby impairing the conductivity of the electrode in the presence of a flame. This lack of conductivity may lead to a false indication as to the quality of the flame being measured.

OBJECTS OF THE INVENTION

It is an object of the invention to provide a flame sensor circuit with the capability of checking the reliability of the conducting electrode.

It is another object of the invention to provide a flame sensor circuitry with the capability of warning when the conductivity of the electrode may have become significantly impaired.

SUMMARY OF THE INVENTION

The above and other objects of the invention are achieved by a programmed microprocessor in association with flame sensor circuitry. The programmed microprocessor checks the responsiveness of the electrode by monitoring the buildup of voltage across a capacitor when the electrode is conducting in the presence of a time. A timer tracks the elapsed time it takes for the capacitor to reach a charged voltage condition indicating the presence of the flame. The microprocessor notes if the elapsed time exceeds a predefined period of time and provides a warning when this occurs.

BRIEF DESCRIPTION OF THE DRAWINGS

Other objects and advantages of the present invention will be apparent from the following description in conjunction with the accompanying drawings in which.

DESCRIPTION OF THE PREFERRED EMBODIMENT

Figure 1:
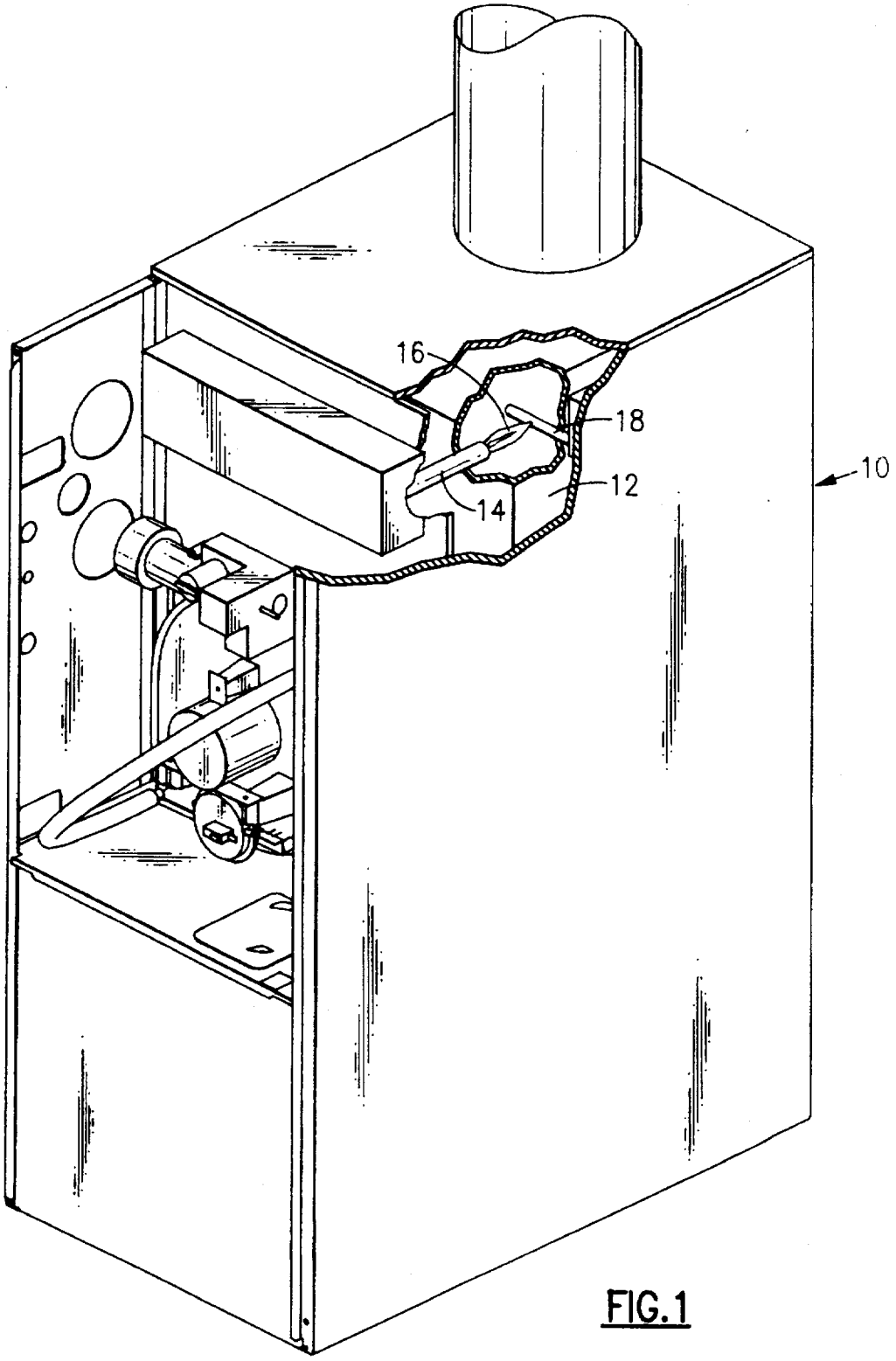
FIG. 1 illustrates a firebox having a burner and an electrode associated therewith for sensing the presence of a flame.

Referring to FIG. 1, a furnace 10 includes a firebox 12 having a burner 14 located therein. The burner 14 will normally receive fuel such as natural gas which is mixed with air and ignited so as to produce a flame 16 which impinges on an electrode 18. In accordance with the invention, the presence of the flame 16 impinging on the electrode 18 will cause an electrical current to flow through the electrode and through the flame to the burner 14 which is electrically grounded within the furnace 10.

Figure 2:
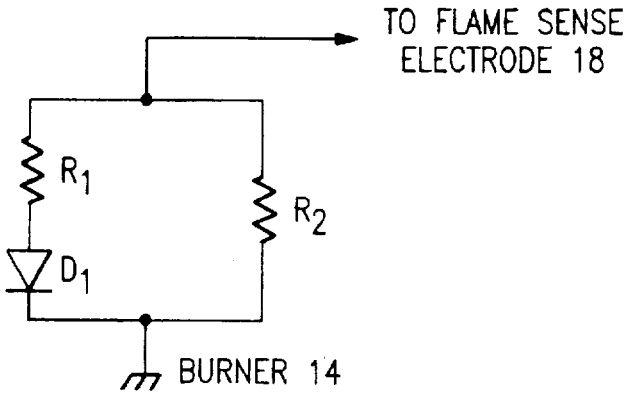
FIG. 2 is an analog circuit depicting the electrical properties of a flame emanating from the burner and impinging on the electrode of FIG. 1.

Referring to FIG. 2, a schematic illustration of an analogous electrical circuit for the flame produced by the burner 14 of FIG. 1 is illustrated. The analogous electrical circuit is seen to include a resistor R, in series with a diode $D_1$ with this pair of components $D_1$ with this pair of components in resistor $R_2$. This resistor diode configuration defines the electrical current path from the electrode 18 through the flame 16 to ground defined by the burner 14. As will be explained in detail hereinafter, the flame 16 as represented by the analogous circuit of FIG. 2 will experience an A.C. voltage applied through the electrode 18. Due to the rectification effect of $D_1$, the current flow from the electrode 18 to ground will be greater when the applied A.C. voltage is positive as opposed to when it is negative.

Figure 3:
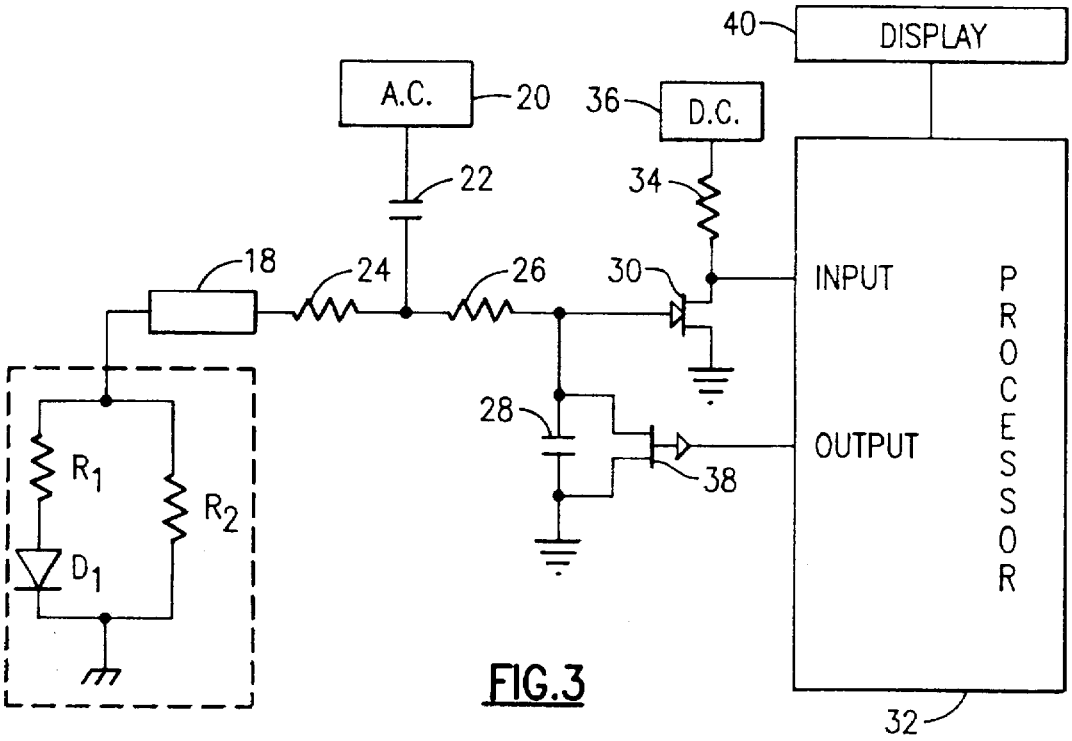
FIG. 3 illustrates a flame sensor system including the electrode positioned above the burner of FIG. 1.
Figure 4:
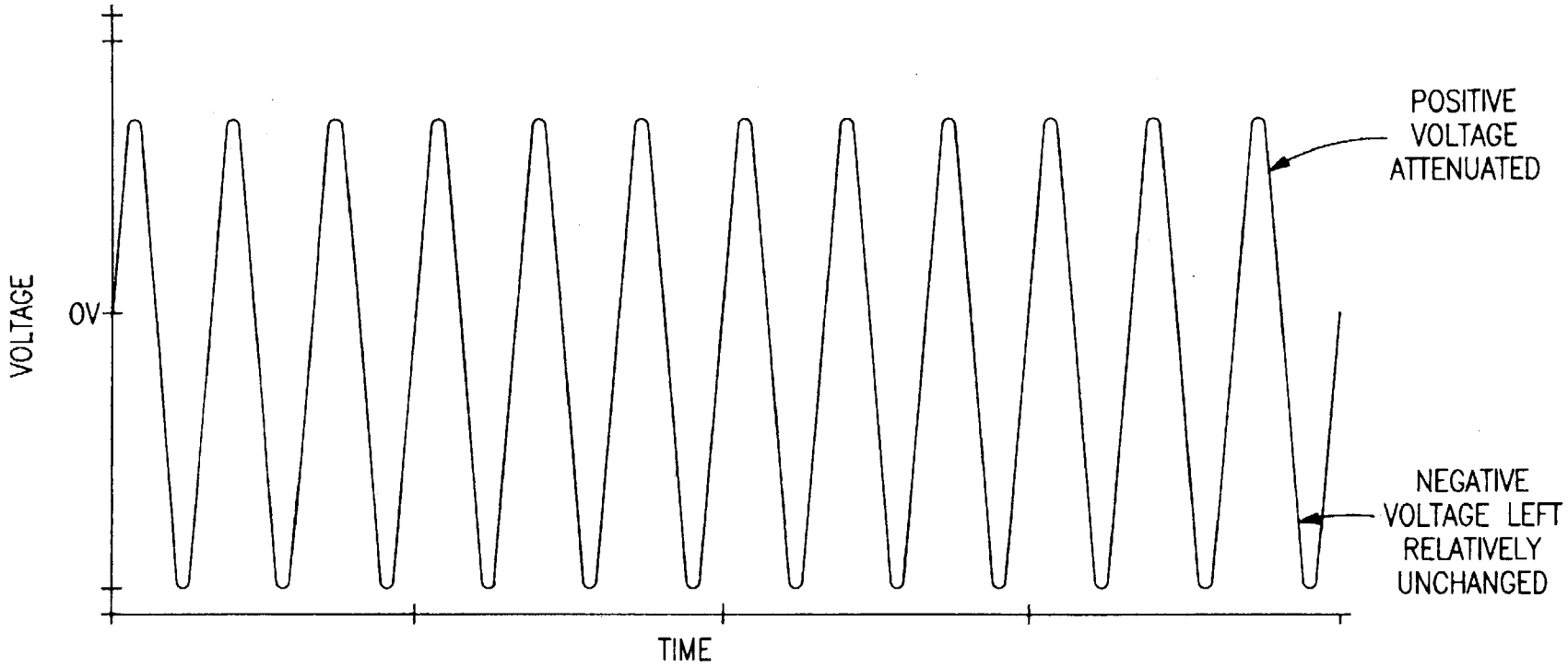
FIG. 4 illustrates the A.C. voltage occurring on the electrode 18 within the flame sense system of FIG. 3 when a flame is present in the firebox of FIG. 1.

Referring to FIG. 3, a flame sense system including the electrode 18 is illustrated relative to the analogous flame circuit of FIG. 2 depicting the flame 16 from the burner 14 of FIG. 1. The flame sense system is seen to include an A.C. power source 20 applying an alternating voltage to the electrode through a high impedance provided by a capacitor 22 and a resistor 24. The resistor 24 limits the current available to the electrode 18 so as to prevent any electrical shock sensation in the event that the electrode is inadvertently touched. While the resistor 24 must be large enough to limit the current available to the electrode 18, it must also be sufficiently small relative to the resistance portion of the impedance of the flame 16 so as to allow the voltage drop from the area of flame impingement on the electrode 18 to ground to be larger than the drop across the resistor 24 and that portion of the electrode upstream of the area of flame impingement. It is hence to be appreciated that the value of the resistor 24 will be a function of certain impedance values that must be measured for a particular burner producing a particular flame impinging on the electrode. As has been previously noted, when flame is present the current flow through the resistor 24 and the electrode 18 will be higher when the A.C. voltage is positive than when it is negative. This higher current flow leads to an attenuation of the voltage present at electrode 18. This attenuated voltage waveform from the area of flame impingement on the electrode 18 to ground is shown in FIG. 4. The average D.C. value of this attenuated voltage is negative.

A resistor 26 and a capacitor 28 define another current path to ground. The resistor 26 and capacitor 28 form a low pass filter and integrator for the voltage formed at the junction of the capacitor 22 and the resistor 24. The resistance value of resister 26 should be similar to or greater than the resistance portion of the impedance of the flame 16 impinging on the electrode 18. As has been previously noted, this can be determined for a particular burner and electrode combination. The capacitor 28 will integrate the current flowing through the resistor 26 over time and develop a voltage when a flame is present. The voltage developed across the capacitor 28 is negative, reflecting the average voltage condition of electrode 18. With flame not present, the A.C. voltage at electrode 18 is not asymmetrically attenuated and the capacitor 28 does not develop a net D.C. voltage. To summarize the above, a negative voltage condition for the capacitor 28 reflects or is an indicator of the negative average D.C. voltage condition present at the electrode 18 when experiencing a flame 16 from the burner 18.

A field effect transistor 30 having an N-channel J-FET gate diode configuration is responsive to the voltage condition present at the junction of the resistor 26 and the capacitor 28. The transistor 30 is in a nonconducting state when the average accumulated voltage across the capacitor 28 builds up as a result of a flame 16 being present. When the transistor 30 is in such a nonconducting state, a resistor 34 in association with a D.C. voltage source 36 pulls an input to the microprocessor 32 to a logical high state indicating a flame has been detected. The transistor 30 will however conduct when the capacitor 28 experiences no voltage buildup with no flame being present. When the transistor 30 is conducting, the input to the microprocessor will remain low.

The microprocessor verifies the responsiveness of the flame sense system from time to time through a field effect transistor 38 having a P-channel J-FET gate diode configuration. The transistor 38 is connected across the capacitor 28. The transistor 38 is operative to shunt the capacitor 28 in response to a logical low signal iota the microprocessor 32. When the logical low signal from the microprocessor goes high, capacitor 28 will normally begin to charge if a flame 16 is present. The capacitor should charge to the net accumulated voltage level that reflects or is an indication of the voltage condition present at the electrode 18. When the capacitor 28 reaches this net accumulated voltage level, the transistor 30 turns off allowing the resistor 34 associated with the D.C. voltage source 36 to pull the microprocessor input to a logical high level. It is to be appreciated that the time the capacitor 28 takes to charge or integrate the current flowing through it to the aforementioned accumulated voltage level will depend on the conductivity of the flame sense electrode 18. In this regard, a build up of foreign material on the electrode 18 will over time reduce the conductivity of the electrode. This change in conductivity will reduce the current flowing through the capacitor 28 which will in turn lengthen the integration time the capacitor takes to achieve the voltage level that triggers the transistor 30.

The microprocessor 32 is seen to be connected to a visual display 40. The visual display 40 physically appears on a control panel associated with the furnace 10. The microprocessor is operative to generate various messages on the display 40 indicative of the status of the flame sense system.

Figure 5:
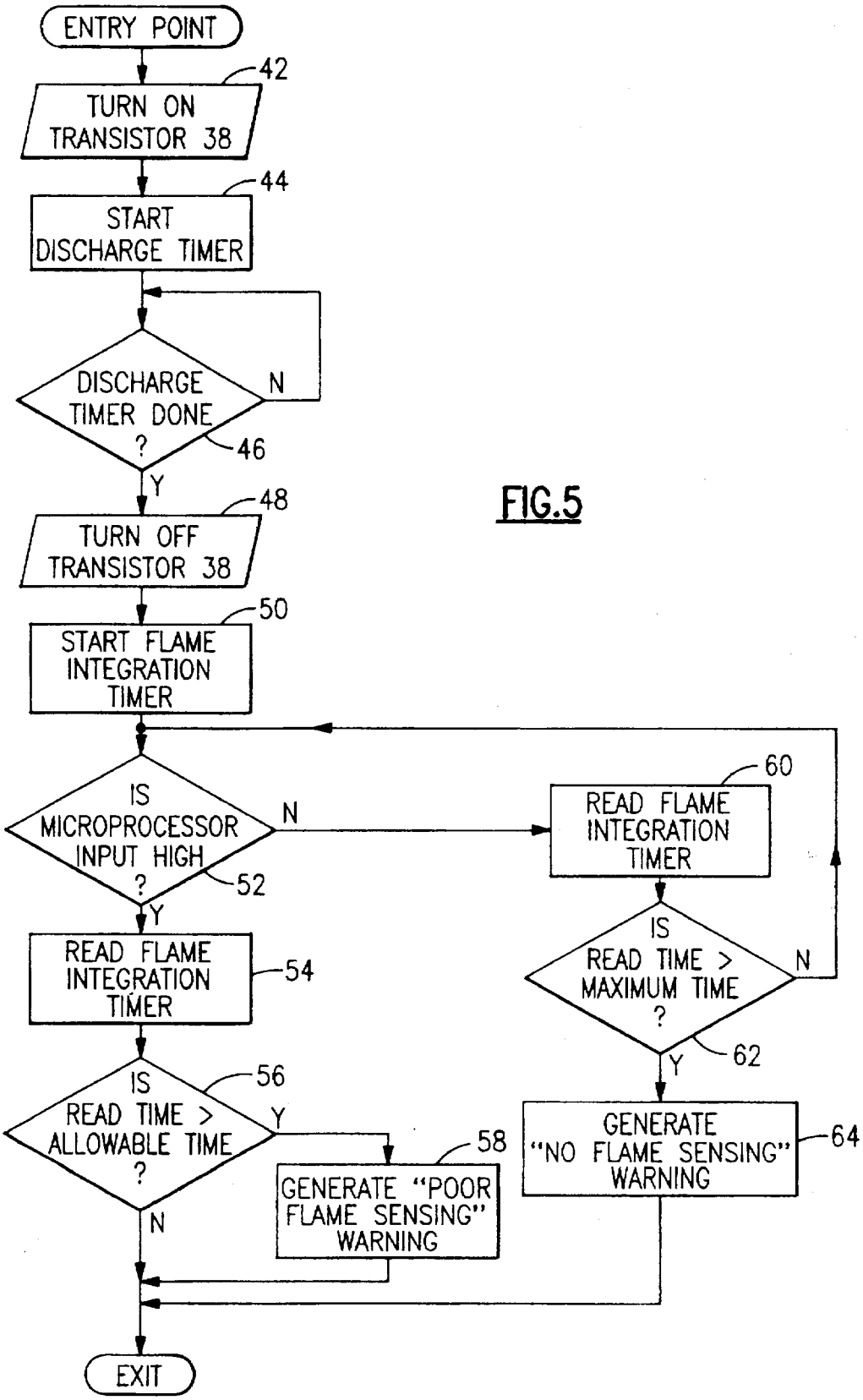
FIG. 5 illustrates a process executable by the microprocessor within the flame sensing system of FIG. 2 for checking the responsiveness of the electrode of FIG. 1.

Referring now to FIG. 5, a time sense verification program executable by the microprocessor 32 is illustrated. The flame sense verification begins with a step 42 wherein the transistor 38 is turned on. This is accomplished by sending a logical low level signal to the gate of the transistor 38. The microprocessor proceeds to a step 44 and starts a discharge timer. The discharge timer preferably begins at a preset time indicative of the amount of time necessary for the capacitor 28 to discharge to essentially zero voltage. The microprocessor proceeds to a step 46 and inquires as to whether the discharge timer has expired thus indicating the voltage across the capacitor 28 to be essentially zero volts. When this occurs, the microprocessor proceeds along the yes path to a step 48 and turns the transistor 38 off by bringing the output of the microprocessor to a logical high level. The microprocessor next proceeds in a step 50 to start a flame current integration timer. The flame timer is preferably an incremental timer beginning at a time zero. The microprocessor now proceeds in a step 52 to inquire as to whether the input to the microprocessor is logically high. It will be remembered that the input to the microprocessor is logically high at such time as the transistor 30 becomes nonconductive due to an appropriate buildup of average voltage across the capacitor 28. When the input goes to a logic high level, the microprocessor proceeds to a step 54 and immediately reads the flame current integration timer. The microprocessor proceeds to a step 56 and inquires as to whether the flame time read in step 54 is acceptable. In this regard, the microprocessor will previously have stored in memory a value of acceptable flame time. It is to be appreciated that this value of acceptable flame time will be a function of the original integration time of the capacitor 28 when a new or fresh electrode 18 is present in the fire box 12 plus any tolerance that is to be permitted to this integration time. The permitted tolerance will be primarily attributable to the increase in integration time due to deterioration in the conductivity of the electrode. It is to be noted that the original integration time of the capacitor 28 for a new or fresh electrode 18 can be determined by monitoring how much time elapses between turning the transistor 38 off at the output and thereafter noting when the transistor 30 switches on so as to bring the input to the microprocessor low. This time could be displayed on the display 40 and noted for several successive on-off cycles of the transistor 38. The average of such response times could be thereafter computed. The permissible deviation or tolerance to the computed average response time would then be determined by taking into account any permissible normal deviation plus any deviation that is to be permitted due to deterioration of the conductivity of the electrode 18. This permissible deviation could be simply added to the aforementioned computed average response in order to arrive at an allowable value of flame time. It is to be noted that alternatively, the electrode 18 could be allowed to deteriorate over time in the fire box to a point where replacement would be deemed advisable. The integration time of the capacitor 28 could be noted for such an electrode. This integration time could be used as the value of the allowable flame time.

Referring again to step 56, in the event that the flame time is unacceptable, the microprocessor proceeds to a step 58 and generates a display warring to the display 40 indicating the flame sensing is poor before exiting the flame sense routine. The microprocessor otherwise directly exits from the flame sense routine if the flame time is deemed acceptable in step 56.

Referring again to step 52, when the input to the microprocessor has not yet attained a high level, the microprocessor will proceed along the no path to a step 60 and read the flame integration timer. The microprocessor will next proceed to a step 62 and inquire as to whether the read time is greater than a maximum allowable time. In this regard, the microprocessor will have previously stored in memory a maximum allowable time for sensing the presence of a flame. As long as this time is not exceeded, the microprocessor will proceed along a no path and return to step 52 to inquire as to whether the input has now gone high. In the event that the maximum time allowed for sensing the flame has been exceeded, the microprocessor will proceed from step 62 to a step 64 and generate a "no flame sensing" warning to the display 40. The microprocessor will proceed to exit the flame sense routine thereafter.

It is to be appreciated that the microprocessor 32 preferably executes a number of control functions required to control the furnace 10 of FIG. 1. The flame sense program is merely one of these control functions which is to be executed from time to time. It is also to be appreciated that a particular embodiment of the invention has been described. Alterations, modifications, and improvements thereto will readily occur to those skilled in the art. Accordingly, the foregoing description is by way of example only and the invention is to be limited only by the following claims and equivalents thereto.

What is claimed is:

1. A system for detecting the presence and quality of a flame being produced by an electrically grounded burner of a furnace, said system comprising:

an electrode mounted in the path of a flame produced by the burner;

an alternating current voltage source connected through a first capacitor and a first resistor to said electrode, said alternating current voltage source causing current to flow through the electrode and through a flame impinging on the electrode to the burner, the current flow through the flame producing an attenuated voltage condition at the electrode caused by the relative conductivity of the flame for positive versus negative voltage fluctuation of the alternating current voltage;

a second resistor connected at one end to a junction between said first resistor and said first capacitor;

a second capacitor connected to the opposing end of said second resistor, said second capacitor in combination with said first capacitor and said second resistor defining a second current path to ground from the alternating current voltage source, said second capacitor charging over time to a capacitance voltage level indicative of the attenuated voltage condition at the electrode; and a processor having an input for sensing when the second capacitor has reached the capacitance voltage level indicative of the attenuated voltage condition at the electrode, said microprocessor including means for measuring the time the second capacitor takes to achieve the capacitance voltage level indicative of the attenuated voltage condition at the electrode.

2. The system of claim 1 further comprising:

a shunting transistor connected across the second capacitor, said shunting transistor being furthermore connected to an output of said processor whereby said means for measuring the time the second capacitor takes to achieve the capacitance voltage level indicative of the attenuated voltage condition at the electrode comprises a means for turning on the shunting transistor so as to discharge the second capacitor and a means for turning the shunting transistor off.

3. The system of claim 2 further comprising:

a second transistor connected to an input of said processor, said second transistor being furthermore connected to a junction between said second resistor and said second capacitor, said second transistor being operative to change voltage levels at the input to said processor when the voltage level of the second capacitor reaches the capacitance voltage level indicative of the attenuated voltage condition at the electrode and wherein said means for measuring the time the second capacitor takes to achieve the capacitance voltage level indicative of the attenuated voltage condition at the electrode comprises means for detecting when the input to said microprocessor changes voltage levels.

4. The system of claim 3 wherein said means for measuring the time the second capacitor takes to achieve the capacitance voltage level comprises:

means for measuring the elapsed time between turning off said shunting transistor and the detection of the voltage level change at the input to said microprocessor;

means for comparing the measured elapsed time with a predetermined allowable time; and means for indicating when the measured elapsed time exceeds the predetermined allowable time.

5. The system of claim 3 wherein said means for measuring the time the second capacitor takes to achieve the capacitance voltage level comprises:

means for inquiring whether the input to the microprocessor has switched voltage levels;

means for reading the elapsed time following the mining off of said shunting transistor;

means for comparing the read elapsed time with a maximum allowable time; and means for indicating when the read elapsed period of time exceeds the maximum allowable time.

6. A process for checking the responsiveness of a system for sensing the presence and quality of a flame generated by a burner within a furnace, the system including an electrode which experiences an attenuated A.C. voltage condition when a flame from the burner impinges on the electrode, the system furthermore including a capacitor which charges to a voltage level indicative of the attenuated voltage condition experienced by the electrode when a flame from the burner impinges on the electrode, said process comprising the steps of:

causing an alternating current to flow through the electrode and through a flame impinging on the electrode;

discharging the capacitor for a predetermined period of time;

allowing the discharged capacitor to again begin charging as a result of the flame impinging on the electrode;

initiating a clock timer following said step of allowing the discharged capacitor to again begin charging;

reading the clock timer when capacitor has changed to a voltage level indicative of the attenuated voltage condition experienced by the electrode;

comparing the read clock time to an allowable period of elapsed clock time if the capacitor has charged to the voltage level indicative of the attenuated voltage condition of the electrode; and displaying a message indicating when the read clock time is greater than the allowable period of time.

7. The process of claim 6 further comprising the steps of:

comparing the read clock time to a maximum allowable period of clock time when the capacitor has not charged to the voltage level indicative of the attenuated voltage condition at the electrode; and displaying a message indicating when the read clock time exceeds the maximum allowable period of clock time.

8. A system for checking the presence and quality of a flame being produced by a burner in a furnace, said system comprising:

an electrode mounted in the path of the time produced by the burner;

an alternating current voltage source, connected to said electrode, for causing current to flow through the electrode and through the flame to the burner acting as a ground for the current flow when a flame is present;

a resistance-capacitance circuit for filtering the alternating current voltage being applied to the electrode, said resistance capacitance circuit including a capacitor which normally experiences a voltage build up in response to current initially flowing through the electrode and through the flame to the burner;

a processor for measuring the time that the capacitor in the resistance-capacitance circuit takes to build up sufficient voltage to indicate the presence of a time, said processor generating a message indicating when the measured time exceeds a predetermined time during which the capacitor is to have built up sufficient voltage to indicate the presence of a flame; and a display for displaying the message generated by said processor indicating when the measured time exceeds a predetermined period of time during which the capacitor is to have built up the sufficient voltage to indicate the presence of a flame.

9. The system of claim 8 further comprising:

a shunting transistor, connected across the capacitor experiencing the voltage build up, and furthermore connected to an output of said processor whereby said shunting transistor is operative to discharge said capacitor in response to a predefined logic level signal from said processor.

10. The system of claim 9 further comprising:

a second transistor, responsive to the build up of voltage across the capacitor in the resistance capacitance circuit, for conducting when the voltage buildup across the capacitor reaches a sufficient voltage to indicate the presence of a time; and a voltage source, upstream of said second transistor, for defining the voltage level being applied to an input of the processor when said second transistor begins conducting in response to the build up of voltage across the capacitor in the resistance capacitance circuit to a sufficient voltage to indicate the presence of a flame.

11. A process for checking the responsiveness of a circuit which detects the presence and quality of a flame produced by a burner in a furnace, said process comprising the steps of:

generating an A.C. voltage potential between an electrode and the burner of the furnace;

filtering an A.C. voltage waveform upstream of the electrode thorough a resistor and a capacitor;

measuring the time it takes to build up a voltage in the capacitor due to the voltage condition occurring at the electrode when a flame is present;

determining when the measured time exceeds a predetermined period of time during which the build-up of voltage in the capacitor is to occur; and displaying a warning indicating that the circuit for detecting the presence and quality of a flame is exceeding the predetermined period of time.

12. The process of claim 11 wherein said step of measuring the time it takes to build up a voltage in the capacitor comprises the steps of:

discharging the capacitor for a predetermined period of time;

initiating a timer when said step of discharging the timer is terminated;

checking whether the build up in voltage in the capacitor indicate that a flame is present; and reading the timer when said detecting step indicates a time is present.

13. The process of claim 12 further comprising the steps of:

reading the timer when said step of checking the build up in voltage in the capacitor does not indicate a flame being present;

comparing the read time of the timer with a maximum allowable period of time; and displaying a message indicating no flame being present when the read time of the timer exceeds the maximum allowable period of time.

* * * * *